US012584662B2

(12) United States Patent
Defay et al.

(10) Patent No.: US 12,584,662 B2
(45) Date of Patent: Mar. 24, 2026

(54) ELECTRO-CALORIC AND/OR PYROELECTRIC HEAT EXCHANGER WITH AN IMPROVED HOUSING

(71) Applicant: LUXEMBOURG INSTITUTE OF SCIENCE AND TECHNOLOGY (LIST), Esch-sur-Alzette (LU)

(72) Inventors: Emmanuel Defay, Esch-sur-Alzette (LU); Mathieu Gerard, Esch-sur-Alzette (LU); Alvar Torelló Massana, Esch-sur-Alzette (LU)

(73) Assignee: LUXEMBOURG INSTITUTE OF SCIENCE AND TECHNOLOGY (LIST), Esch-sur-Alzette (LU)

( * ) Notice: Subject to any disclaimer, the term of this patent is extended or adjusted under 35 U.S.C. 154(b) by 718 days.

(21) Appl. No.: 17/787,487

(22) PCT Filed: Feb. 19, 2021

(86) PCT No.: PCT/EP2021/054101
§ 371 (c)(1),
(2) Date: Jun. 20, 2022

(87) PCT Pub. No.: WO2021/123460
PCT Pub. Date: Jun. 24, 2021

(65) Prior Publication Data
US 2023/0033512 A1 Feb. 2, 2023

(51) Int. Cl.
*F25B 21/00* (2006.01)

(52) U.S. Cl.
CPC ..... *F25B 21/00* (2013.01); *F25B 2321/001* (2013.01)

(58) Field of Classification Search
CPC ... F25B 21/00; F25B 2321/001; H10N 15/10; Y02B 30/00
See application file for complete search history.

(56) References Cited

U.S. PATENT DOCUMENTS

2002/0062649 A1* 5/2002 Ohkubo ..... H10N 10/00 62/3.7
2010/0175392 A1 7/2010 Malloy et al.
(Continued)

FOREIGN PATENT DOCUMENTS

CN 111379912 A * 7/2020 ..... B60H 1/00557
RU 2079802 C1 * 5/1997 ..... F25B 21/00
(Continued)

OTHER PUBLICATIONS

International Search Report for PCT/EP2021/054101 mailed May 18, 2021.
(Continued)

*Primary Examiner* — Jianying C Atkisson
*Assistant Examiner* — Ibrahim A. Michael Adeniji
(74) *Attorney, Agent, or Firm* — Sandberg Phoenix & von Gontard, P.C.

(57) ABSTRACT

A heat exchanger comprising at least two substrates made of electro-caloric and/or pyroelectric material and stacked one on the other so as to form between the at least two substrates and at least one channel for a fluid; at least two electrodes at two opposed ends of the at least two substrates; a housing enclosing the stack of the at least two substrates and the at least two electrodes, and provided with at least one fluid connecting port; wherein the housing is made of a heat shrinkable flexible tube that is shrunk onto the stack of the at least two electrodes and forming the at least one fluid connecting port.

11 Claims, 2 Drawing Sheets

(56) References Cited

U.S. PATENT DOCUMENTS

| | | | | |
|---|---|---|---|---|
| 2010/0244863 | A1* | 9/2010 | Sasaki | F25B 49/005 324/694 |
| 2017/0030611 | A1* | 2/2017 | Radcliff | F25B 21/00 |
| 2018/0059690 | A1* | 3/2018 | Coleman | B23P 11/00 |
| 2021/0308733 | A1* | 10/2021 | Annapragada | B23P 15/26 |

FOREIGN PATENT DOCUMENTS

| | | | | |
|---|---|---|---|---|
| SU | 840621 | A1 | 6/1981 | |
| WO | WO-2008154362 | A2 * | 12/2008 | F25B 21/00 |

OTHER PUBLICATIONS

Written Opinion for PCT/EP2021/054101 mailed May 18, 2021.
Trev I Zou p V et al: "Thermal-hydraulic evaluation of 3D printed microstructures", App Li Ed Thermal Engineering, Pergamon, Oxford, GB, vol. 160, Jun. 21, 2019 (Jun. 21, 2019), XP085781790, ISSN: 1359-4311, DOI: 10.1016/J.APPLTHERMALENG.2019.113990 [retrieved—on Jun. 21, 2019]p. 1 p. 5• • figures—1. 3a-3d.
A Tura et al: "Experimental performance evaluation of sintered Gd spheres packed beds", International Conference on Magnetic Refrigeration at Room Temperature, Jan. 1, 2016 (Jan. 1, 2016), pp. 11-14, XP055724671, DOI: 10.18462/iir.thermag.2016.0184 Retrieved from the Internet: URL:https://www.researchgate.net/publication/308740100 EXPERIMENTAL PERFORMANCE EVAL UATION OF SINTERED Gd SPHERES PACKED BEDS [retrieved on Aug. 24, 2020]—the whole document.

* cited by examiner

ELECTRO-CALORIC AND/OR PYROELECTRIC HEAT EXCHANGER WITH AN IMPROVED HOUSING

The present invention is the US national stage under 35 U.S.C. § 371 of International Application No. PCT/EP2021/054101 which was filed on Feb. 19, 2021, and which claims the priority of application LU 101559 filed on Dec. 19, 2019 the contents of which (text, drawings and claims) are incorporated here by reference in its entirety.

ACKNOWLEDGMENT

The invention described hereafter has been generated within the research project entitled "Materials for sensing and energy harvesting", supported by the National Research Fund, Luxembourg (Ref. PRIDE15/10935404/MASSENA).

FIELD

The invention is directed to the field of heat exchangers using the electro-caloric effect.

BACKGROUND

The electro-caloric effect is a phenomenon in which a material shows a reversible temperature change under an applied electric field. It is often considered to be the physical inverse of the pyroelectric effect. It should not be confused with the magneto-caloric effect needing a large magnetic field as well as powerful and costly magnets, and also the Thermoelectric effect (specifically, the Peltier effect), in which a temperature difference occurs when a current is driven through an electric junction with two dissimilar conductors. The underlying mechanism of the electro-caloric effect comes from the voltage raising or lowering the entropy of the system.

Prior art patent document published SU 840621 discloses a refrigerating or cold producing device using the electro-caloric effect. The device comprises a central heat exchanger with stacked plates made of electro-caloric material, spaced from each other so as to form between the plates a series of parallel fluid channels. The stack of electro-caloric plates is surrounded by a housing providing two opposed fluid connecting ports. Opposed ends of the electro-caloric plates of the stack are in contact with two electrodes which are connected to an electric power supply. An auxiliary heat exchanger is fluidly connected to each of the two opposed fluid connecting ports. A reciprocating displacement pump is fluidly connected to each of the two auxiliary heat exchanger for moving the fluid from the central heat exchanger to the first auxiliary heat exchanger and from the central heat exchanger to the second auxiliary heat exchanger in a reciprocating manner while the electrodes are powered on and off in an alternating manner.

The functioning principle of the above device is the following. When powering on the electro-caloric plates, the temperature of the latter increases and the fluid is moved from the first auxiliary heat exchanger to the main heat exchanger and is thereby heated. Thereafter the fluid is moved in the opposite direction, i.e., back to the first auxiliary heat exchanger, while the electro-caloric plates are powered off. This means that concomitantly the temperature of the electro-caloric plates decreases due to the heat transfer to the fluid moving to the first heat exchanger and also due to the release of the electric field. Also, still concomitantly, the fluid in the second auxiliary heat exchanger is moved to the main heat exchanger and receives heat therefrom. The fluid is then moved as in the first movement, i.e., back to the second heat exchanger, while the electro-caloric plates are again powered on for the next cycle. The first heat exchanger shows an increasing temperature and can therefore supply heat, i.e., heat a medium, whereas the second heat exchanger shows a decreasing temperature and can therefore receive heat, i.e., cool a medium.

In the above teaching, the temperature differences achieved in the central heat exchanger are limited, e.g., a few degrees Celsius or Kelvin, and are cyclic. This means that a proper thermal insulation is necessary. The construction of the central heat exchanger in the above teaching shows however a high thermal inertia and poor insulation, thereby reducing the temperature difference achievable.

SUMMARY

The invention has for technical problem to provide an improved heat exchanger with regard to the temperature difference that can be achieved.

The invention is directed to a heat exchanger comprising at least one substrate made of electro-caloric and/or pyroelectric material and forming at least one channel for a fluid; at least two electrodes at two opposed ends of the at least one substrate; a housing enclosing the at least one substrate and the at least two electrodes, and provided with at least one fluid connecting port; wherein the housing is made of a heat shrinkable flexible tube that is shrunk onto the at least one substrate and forming the at least one fluid connecting port.

The at least one substrate can comprise at least two, in various instances at least three, for example at least four of the substrates.

According to an exemplary embodiment, the heat shrinkable flexible tube tightly fits on the at least one substrate.

According to an exemplary embodiment, the at least one channel for the fluid shows a main direction along which the heat shrinkable flexible tube extends.

According to an exemplary embodiment, the two ends of the at least one substrate, with the at least two electrodes, are transversal ends.

According to an exemplary embodiment, the heat exchanger further comprises: electrical leads connected to the at least two electrodes and extending between at least one outer face of the at least one substrate and an inner face of the heat shrinkable flexible tube.

According to an exemplary embodiment, the electrical leads extend out of the shrinkable flexible tube through the at least one fluid connecting port.

According to an exemplary embodiment, the heat exchanger further comprises at least one hose inside the at least one fluid connecting port, respectively.

According to an exemplary embodiment, the at least one hose is glued to the corresponding fluid connecting port.

The at least one channel can be formed inside the at least one substrate.

According to an exemplary embodiment, the at least one substrate comprises a single substrate and spacers are provided on two opposed faces of the single substrate so as to form with the shrinkable flexible tube two of the at least one channel for the fluid.

According to an exemplary embodiment, the at least one substrate comprises at least two of the substrates stacked one on the other so as to form between the at least two substrates the at least one channel for the fluid.

According to an exemplary embodiment, each of the at least two electrodes is formed by electrically connecting together corresponding ends of the at least two substrates. This can be done by soldering, applying an electrically conductive tape, and/or applying an electrically conductive paste.

According to an exemplary embodiment, the at least two substrates are spaced from each other by spacers arranged at the two opposed ends of the at least two substrates.

According to an exemplary embodiment, the spacers extend along a main direction of the at least one channel for the fluid.

According to an exemplary embodiment, additional spacers are provided on two opposed faces of the stack of the at least two substrates so as to form with the shrinkable flexible tube two of the at least one channel for the fluid.

The invention is also directed to a device for producing heat and/or cold, comprising an electro-caloric heat exchanger with a first fluid connecting port and a second fluid connecting port opposed to the first fluid connecting port; a first auxiliary heat exchanger fluidly connected to the first fluid connecting port; a second auxiliary heat exchanger fluidly connected to the second fluid connecting port; a fluid displacement unit configured for moving the fluid in a reciprocating manner from the electro-caloric heat exchanger to the first auxiliary heat exchanger and from the electro-caloric heat exchanger to the first auxiliary heat exchanger; an electric power supply configured for intermittently powering on and powering off the electro-caloric heat exchanger while the fluid displacement unit moves the fluid in the reciprocating manners so as to; wherein the electro-caloric heat exchanger is according to various embodiments of the invention.

According to an exemplary embodiment, the device further comprises a first hose extending inside the first fluid connecting port and fluidly connected to the first auxiliary heat exchanger; and a second hose extending inside the second fluid connecting port and fluidly connected to the second auxiliary heat exchanger.

The invention is also directed a device for producing electrical energy, comprising: a pyroelectric heat exchanger; a heat source; a cold source; a fluid displacement unit configured for moving the fluid in a successive manner from the heat source to the pyroelectric heat exchanger and from the cold source to the pyroelectric heat exchanger; an electric load configured for collecting electrical charges from the pyroelectric heat exchanger while the fluid displacement unit moves the fluid in the successive manner; wherein the pyroelectric heat exchanger is a heat exchanger according to various embodiments of the invention.

The electric load can comprise a capacitor and a power supply configured for applying an electrical field to the capacitor before each movement of the fluid from the heat source to the pyroelectric heat exchanger.

According to an exemplary embodiment, the fluid displacement unit comprises a reciprocating pump, and the reciprocating pump, the heat source and the cold source are fluidly connected to each other in series so as to form a sub-circuit that is fluidly connected to a first fluid connecting port of the pyroelectric heat exchanger (6) and to a second fluid connecting port of the pyroelectric heat exchanger, opposed to the first fluid connecting port.

According to an exemplary embodiment, the fluid displacement unit comprises a pump, a first selection valve and a second selection valve, the heat source and the cold source being arranged in parallel and fluidly connected to the pyroelectric heat exchanger and the pump via the first and second selection valves so as to form a closed circuit where the fluid circulating through the circuit selectively passes through the heat source or the cold source.

The invention is also directed to a method for manufacturing a heat exchanger, comprising the following steps: (a) providing at least one substrate made of electro-caloric and/or pyroelectric material forming at least one channel for a fluid; (b) forming at least two electrodes at two opposed ends of the at least one substrates; and (c) providing a housing enclosing the at least one substrate and the at least two electrodes, and provided with at least one fluid connecting port; wherein the step (c) comprises inserting the at least one substrate into a heat shrinkable flexible tube and thereafter heating the heat shrinkable flexible tube so as to shrink onto the at least one substrate and form at least one fluid connecting port.

The invention is particularly interesting in that it substantially reduces the thermal inertia of the heat exchanger, thereby substantially increasing the temperature difference that can be achieved when the heat exchanger is implemented in a device for producing heat and/or cold, as well as in a device for producing electrical energy from heat and cold sources. The inner volume of the heat exchanger shows no dead volume, the plastic material of the heat shrinkable flexible tube forms a first useful thermal insulating barrier, and the mass of the plastic material is very limited. The inventors have indeed found out that the housing of the heat exchanger does not need to support important pressures or forces, so that the present solution is particularly interesting.

DRAWINGS

Figure 5:
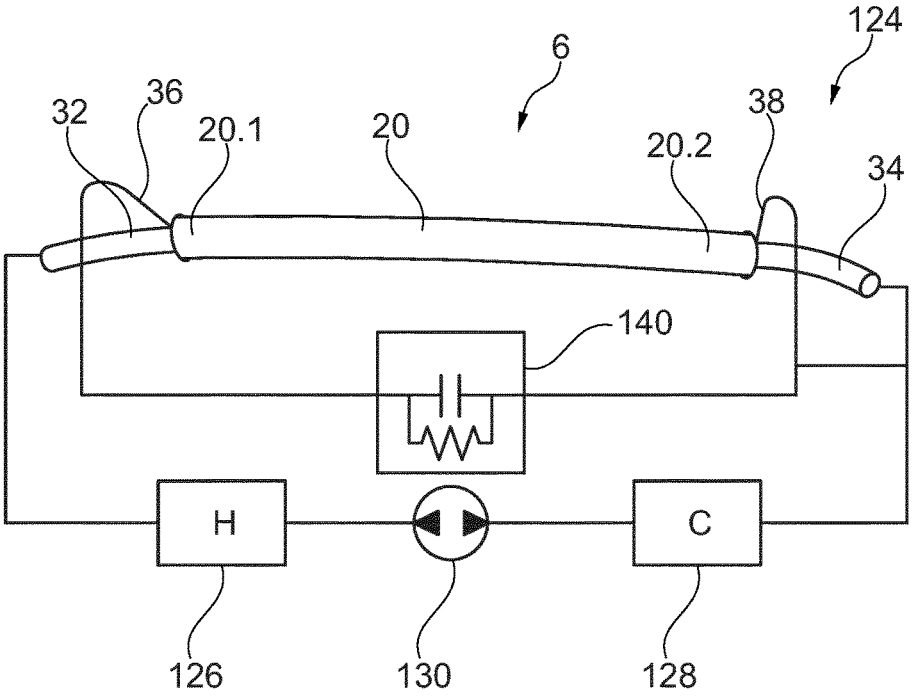

FIG. 5 an exemplary perspective view of the heat exchanger of the invention integrated in a device for producing electrical energy according to various embodiments of the invention.

Figure 6:
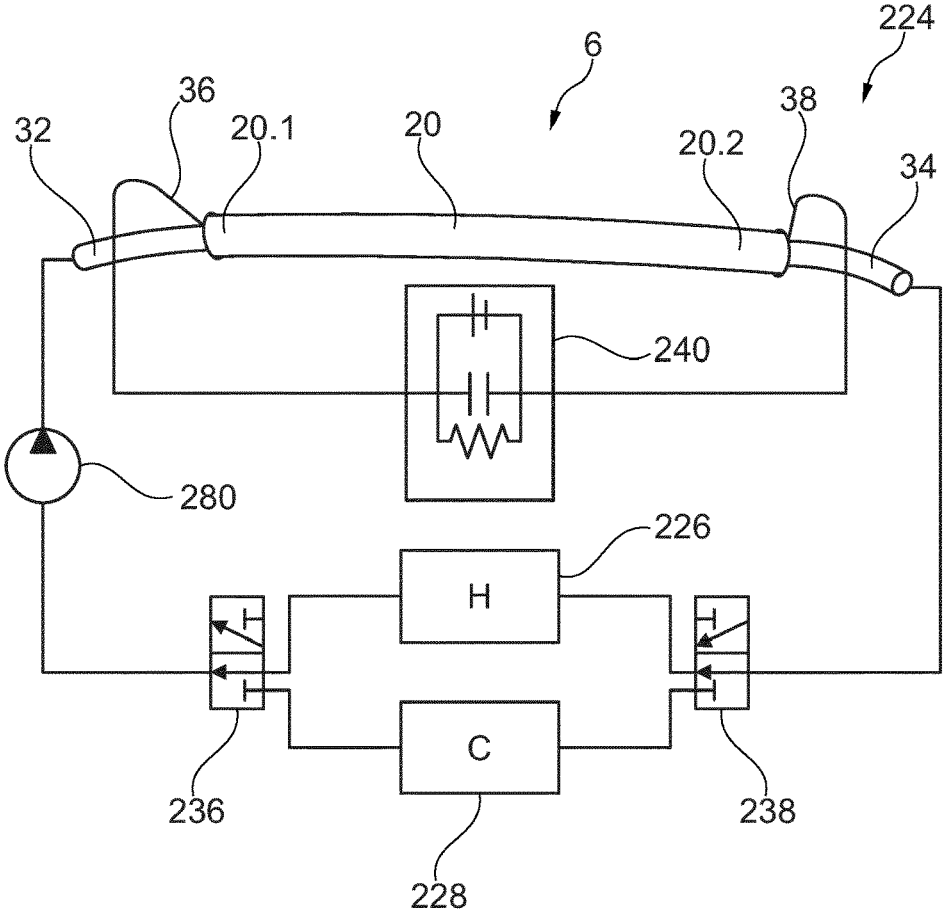

FIG. 6 an exemplary perspective view of the heat exchanger of the invention integrated in a further device for producing electrical energy according to various embodiments of the invention.

DETAILED DESCRIPTION

The electro-caloric effect is an adiabatic and reversible temperature change that occurs in a polar material upon application of an electric field. Large electro-caloric effect can be obtained in ferroelectric materials with perovskite structure since their polarization exhibits great dependency on temperature approaching to the ferroelectric phase transition temperature (Tc) especially with the compositions around the morphotropic phase boundary (MPB). Also, thin films of the material PZT (a mixture of lead, titanium, oxygen and zirconium) show a strong electro-calorific response, with the material cooling down by as much as about 12° C. for an electric field change of 480 kV/cm, at an ambient temperature of 220° C.

Figure 1:
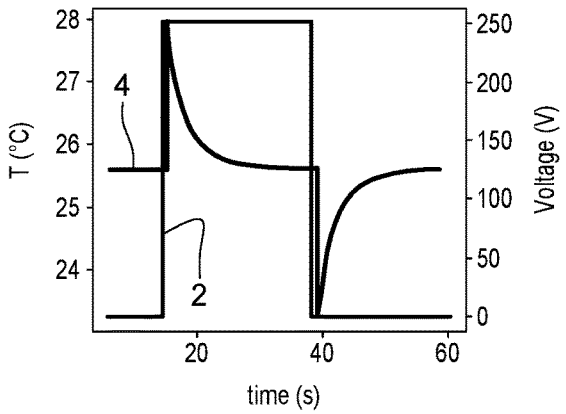
FIG. 1 is a graphic of the temperature and voltage illustrating the principle of the electro-caloric effect.

FIG. 1 shows graphically the variation over time of the temperature in an electro-caloric material when applying an electric field. The electric field 2 shows a rectangular profile, i.e., is applied with a voltage of 250 volts during more than 20 seconds. The resulting temperature 4 in the material shows an upper peak with an increase of more than 2° C. upon application of the electric field after what the temperature decreases back to its initial value due to material relaxation. The temperature shows then a lower peak, of about the same amplitude as the upper peak, when the electrical field is ceased. The temperature behaviour in the upper and lower peaks is used here as the electro-caloric effect.

Figure 2:
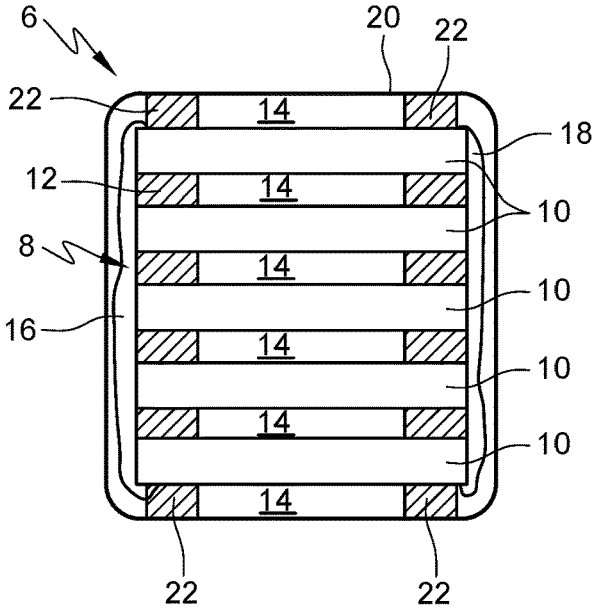
FIG. 2 is an exemplary cross-sectional view of a heat exchanger according to various embodiments of the invention.

FIG. 2 is cross-section view of a heat exchanger according to various embodiments the invention.

The heat exchanger 6 comprises a stack 8 of substrates 10, for instance plates that are spaced from each other by means of spacers 12 for forming fluid channels 14 between the substrates 10. The latter are made of electro-caloric material, like any one of those briefly discussed above or any other known from the skilled person. The fluid channels 14 are parallel and extend along a main direction of the heat exchanger which is perpendicular to the plane of the cross-sectional view. As this is apparent, the spacers 12 are positioned so as to be adjacent to the lateral edges of the substrates 10. The spacers can show adhesive layers for adhering on the substrates 10, thereby enabling to form a stable stack 8 of substrates 10.

Still with reference to FIG. 2, the lateral ends of the substrates are soldered together on each lateral side, thereby forming the electrodes 16 and 18. An electric voltage can be applied to these electrodes for generating an electric field in each substrate 10. The heat exchanger 6 comprises also a housing formed by a heat shrinkable flexible tube 20 is shrunk onto the stack 8 of substrates 10. Heat-shrink tubing, or commonly, heat shrink or heatshrink, is a shrinkable plastic tube normally used to insulate wires, providing abrasion resistance and environmental protection for stranded and solid wire conductors, connections, joints and terminals in electrical work. It is ordinarily made of polyolefin, which shrinks radially (but not longitudinally) when heated, to between one-half and one-sixth of its diameter. The heat shrinkable flexible tube 20, in its shrunk state as exemplarily illustrated in FIG. 2, tightly fits on the stack 8 of substrates 10, so the fluid channels 14 between the substrates 10 are the only possible flow channels along the heat exchanger 6.

As this is apparent in FIG. 2, additional spacers 22 can be provided on the outer opposed faces of the stack 8 of substrates 10, more specifically on the outer faces of the external substrates of the stack 8 of substrates 10, so as to form fluid channels 14 between the outer face each of these two substrates and the inner corresponding face of the heat shrinkable flexible tube 20. The additional spacers 22 are also adjacent to the lateral edges of the corresponding substrates 10.

In alternative to the above described stack of substrates 10, the substrate can be single and form fluid channel(s) either internally, i.e., inside the substrate, and/or with spacers on the outer opposed faces of the substrate like the above spacers 22.

The heat shrinkable flexible tube 20 is black but can be of different colours.

Figure 3:
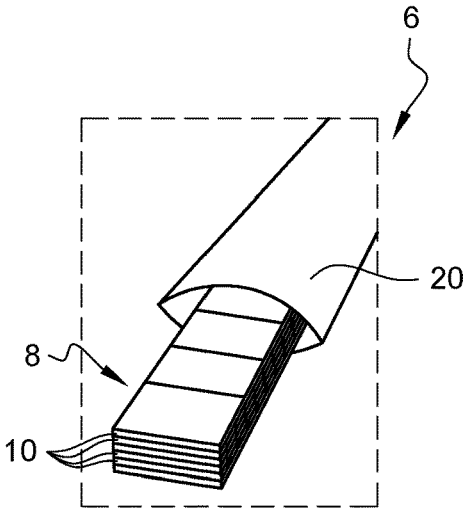
FIG. 3 is an exemplary perspective view of the heat exchanger of the invention prior thermal shrinking of the shrinkable flexible tube forming the housing thereof according to various embodiments of the invention.

FIG. 3 is a perspective view of the heat exchanger 6 according to various embodiment of the invention where however the heat shrinkable flexible tube 20 is not yet shrunk. We can observe that the heat shrinkable flexible tube 20 shows an inner circumference that is substantially larger than the outer circumference of the stack 8 of substrates 10. This allows the stack 8 of substrates 10 to be easily inserted into the heat shrinkable flexible tube 20. Thereafter the heat shrinkable flexible tube 20 is heated and shrinks onto the stack 8 of substrates 10 for arriving at a tight fit as exemplarily illustrated in FIG. 2.

As this is apparent in FIG. 3, the substrates 10 can extend along a main direction corresponding to the main direction of the heat exchanger 6 and of the heat shrinkable flexible tube 20, while each substrate 10 can show a series of sub-sections adjacent next to each other along that main direction.

A method of manufacturing the heat exchanger, can comprise the following steps:

(a) stacking the substrates one on the other, in various instances by means of the spacers, so as to form between them the fluid channels;

(b) forming the electrodes at the two opposed ends of the substrates and connecting the electrical leads thereto; and (c) inserting the stack of the substrates with the electrical leads into the heat shrinkable flexible tube and thereafter heating the heat shrinkable flexible tube so as to shrink onto the stack and form the fluid connecting ports.

The above detailed construction is advantageous in that there is no dead volume in the passage for the fluid and in that the wall of the heat shrinkable flexible tube provides a good first thermal insulation barrier in comparison with most of the current materials used for forming a housing, like metal based materials. The generally cylindrical outer form of the heat exchanger allows it to be easily surrounded by one or several insulation covers. In that case, the thermal inertia of the heat exchanger is limited to the electro-caloric substrates and the heat shrinkable flexible tube whereas the latter shows a reduced mass.

Figure 4:
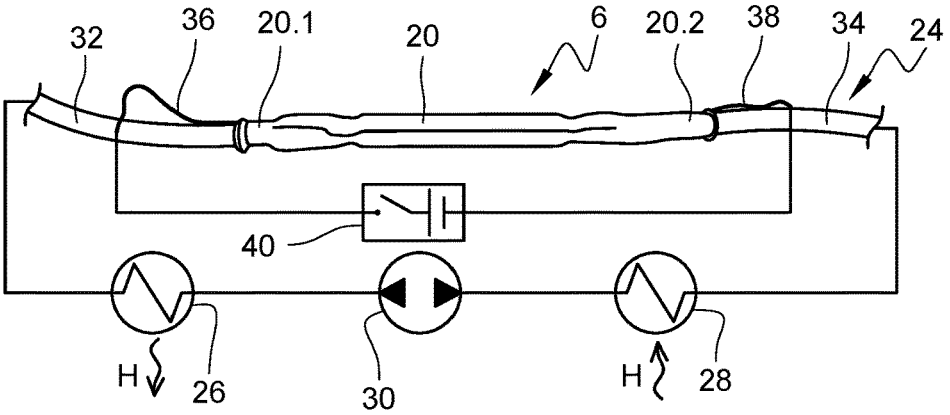
FIG. 4 is an exemplary perspective view of the heat exchanger of the invention integrated in a device for producing heat and/or cold according to various embodiments of the invention.

FIG. 4 exemplarily illustrates the heat exchanger of the invention integrated into a device for producing heat and/or cold.

The device 24 comprises, essentially, the heat exchanger 6 as in FIGS. 2 and 3 and the above description, a first auxiliary heat exchanger 26 fluidly connected to a first fluid connecting port 20.1 of the heat exchanger 6, a second auxiliary heat exchanger 28 fluidly connected to a second fluid connecting port 20.2 of the heat exchanger 6, and a fluid displacement unit 30 fluidly interconnecting the first and second auxiliary heat exchangers 26 and 28, and configured for moving the fluid in two opposed direction, in a reciprocating manner. For instance, each of the first and second fluid connecting ports 20.1 and 20.2 is formed by the heat shrinkable flexible tube 20. The first auxiliary heat exchanger 26 is fluidly connected to the heat exchanger 6 by a first hose 32 that is inserted into the first fluid connecting port 20.1 on a corresponding end of the heat shrinkable flexible tube 20 that once shrunk onto the hose 32 forms a tight connection. Similarly, the second auxiliary heat exchanger 28 is fluidly connected to the heat exchanger 6 by a second hose 34 that is inserted into the second fluid connecting port 20.2 on the other and corresponding end of the heat shrinkable flexible tube 20 that once shrunk onto the hose 34 forms a tight connection. Glue or any other kind of sealant can be applied for increasing the mechanical strength and/or fluid tightness of the connection.

Two electrical leads or wires 36 and 38 are connected to the electrodes (not visible in FIG. 4 but well in FIG. 2 at references 16 and 18) and extend along the main direction of the heat exchanger and through the first and second fluid connecting ports 20.1 and 20.2. More specifically, each electrical lead 36 and 38 extends between one of the fluid connecting ports 20.1/20.2 and the corresponding hose 32/34. The electrical leads 36 and 38 are connected to an electric power source 40 that is switchable, i.e., so that the electro-caloric substrates can be selectively powered on and off.

The operation of the device in FIG. 4 is as follows. In a first cycle, the electric power source 40 is switched on for powering on the electro-caloric substrates, leading to a rapid increase of the temperature of the substrates. Heat is then transferred from the substrates to the fluid. Concomitantly, the fluid displacement unit 30 is operated for moving the fluid from the heat exchanger 6 to the first auxiliary heat exchanger 26, thereby bringing heat to the auxiliary heat exchanger. In the same time fluid from the second auxiliary heat exchanger has moved to the heat exchanger 6 while, or after what, the electric power source 40 is switched off, leading to a temperature decrease in the substrates. Heat is then transferred from the fluid (originating from the second auxiliary heat exchanger) to the substrates. The differently, the fluid from the second auxiliary heat exchanger 28 that moved to the heat exchanger 6 is cooled down. A second cycle identical to the first one can then take place, and so on in a reciprocating manner.

FIGS. 5 and 6 exemplarily show two devices for producing electrical energy using the heat exchanger of the invention, the heat exchanger being in that case a pyroelectric heat exchanger.

The pyroelectric effect is the ability of certain materials to generate a temporary voltage when they are heated or cooled. The change in temperature modifies the positions of the atoms slightly within the crystal structure, such that the polarization of the material changes. This polarization change gives rise to a voltage across the crystal. The pyroelectric effect can generally be considered as the physical inverse of the electro-caloric effect. This means that the above-described electro-caloric heat exchanger can be used as a pyroelectric heat exchanger, and vice versa.

The device 124 is very similar to the device 24 of FIG. 4. It is therefore referred to the detailed description of FIG. 4. The device 124 differs from the device 24 in FIG. 4 essentially in that the electrical power source is replaced by an electrical load 140 and in that the auxiliary heat exchangers are replaced by a heat source 126 and a cold source 128. Important is however to note that in practice, the heat source 126 can comprise an auxiliary heat exchanger receiving heat, or a heat reservoir. Similarly, the cold source can comprise an auxiliary heat exchanger dissipating heat, or a cold reservoir.

In operation, the fluid displacement unit 130, that can be a reciprocating pump, moves the fluid from the heat source 126 to the heat exchanger 6, leading to an increase of temperature of the electro-caloric/pyroelectric substrates in the heat exchanger 6, thereby producing an electrical voltage that charges the electrical load 140. The latter is represented as comprising a capacitor, being understood that such an electrical load can be substantially more sophisticated, e.g., by comprising diodes or switching means for controlling the electrical charge during that cycle and the discharge during the next cycle. During that first cycle, the fluid initially contacting the electro-caloric/pyroelectric substrates is moved towards the cold source 128. During the second cycle, the fluid is moved in the opposed direction, i.e., from the cold source 128 to the heat exchanger 6, leading to a lowering of the temperature of the electro-caloric/pyroelectric substrates in the heat exchanger 6. The electrical load is configured to keeping its electrical charge or to transmit it to an electrical consumer connected thereto. In the next third cycle, identical to the first one, the fluid is moved from the heat source 126 to the heat exchanger 6, thereby further electrically charging the electrical load 140.

The thermodynamic cycle described here above is a Stirling thermodynamic cycle.

The device 224 in FIG. 6 works on the same principle as the device 124 in FIG. 5 where however the fluid instead of being moved in a reciprocal manner, is moved in the same direction but by passing in an alternating manner through the heat source and the cold source, in order to generate in the electro-caloric substrates successive temperature increases and temperature decreases which produce successive electrical field increases and decreases, resulting in a pulsed electrical power signal. In addition, an external electrical field is applied to the capacitor in an intermittent fashion during before heating.

The fluid displacement unit comprises a pump 230 and selection valves 236 and 238 which are designed for selectively allowing the fluid flow to pass through the heat source 226 or the cold source 228. While the pump 230 circulates the fluid in the same direction, the valves 236 and 238 are operated in a successive manner so as to successively allow the fluid to pass through the heat source 226 or the cold source 228 in an alternating manner. The valves 236 and 238 can be three-way valves with two positions that selectively fluidly connects one of two ports to a third port, the two ports being fluidly connected to the heat and cold sources and the third port being fluidly connected to the heat exchanger 6. Such valves are well known and widely commercially available.

The resulting pulsed electrical power signal is similar to the one of the device 124 of FIG. 5.

The electrical load 240 is however somehow different from the electrical load 140 of the device 124 of FIG. 5 in that a power supply is present for applying in an intermittent fashion a voltage to the capacitor, before each heating recurrent step.

The thermodynamic cycle described here above is an Olsen thermodynamic cycle.

What is claimed is:

1. A heat exchanger, said heat exchanger comprising:

at least one substrate made of electro-caloric or pyroelectric material and forming at least one channel for a fluid;

at least two electrodes at two opposed ends of the at least one substrate;

a housing enclosing the at least one substrate and the at least two electrodes, and provided with at least one fluid connecting port;

wherein the housing is made of a heat shrinkable flexible tube that is shrunk onto the at least one substrate and forming the at least one fluid connecting port;

wherein the at least one substrate comprises at least two substrates stacked one on the other so as to form between the at least two substrates the at least one channel for a fluid;

wherein the at least two substrates are spaced from each other by spacers arranged at the two opposed ends of the at least two substrates;

wherein additional spacers are provided on two opposed faces of the stack of the at least two substrates so as to form with the heat shrinkable flexible tube two of the at least one channel for the fluid.

2. The heat exchanger according to claim 1, wherein the heat shrinkable flexible tube tightly fits on the at least one substrate so that the at least one channel is the only possible flow channel along the heat exchanger.

3. The heat exchanger according to claim 1, wherein the at least one channel for the fluid shows a main direction along which the heat shrinkable flexible tube extends.

4. The heat exchanger according to claim 3, wherein the two ends of the at least one substrate, with the at least two electrodes, are transversal ends.

5. The heat exchanger according to claim 1, further comprising:

electrical leads connected to the at least two electrodes and extending between at least one outer face of the at least one substrate and an inner face of the heat shrinkable flexible tube.

6. The heat exchanger according to claim 5, wherein the electrical leads extend out of the heat shrinkable flexible tube through the at least one fluid connecting port.

7. The heat exchanger according to claim 1, further comprising:

at least one hose inside the at least one fluid connecting port, respectively.

8. The heat exchanger according to claim 7, wherein the at least one hose is glued to the corresponding fluid connecting port.

9. The heat exchanger according to claim 1, wherein the at least one substrate comprises a single substrate, and spacers are provided on two opposed faces of the single substrate so as to form with the heat shrinkable flexible tube two of the at least one channel for the fluid.

10. The heat exchanger according to claim 1, wherein each of the at least two electrodes is formed by electrically connecting together corresponding ends of the at least two substrates.

11. The heat exchanger according to claim 1, wherein the spacers extend along a main direction of the at least one channel for the fluid.

* * * * *